US006715520B2

(12) United States Patent
Andréasson et al.

(10) Patent No.: US 6,715,520 B2
(45) Date of Patent: Apr. 6, 2004

(54) METHOD AND ASSEMBLY FOR FLUID TRANSFER

(75) Inventors: Kjell Andréasson, Vastra Frolunda (SE); Jerry Strandhav, Gothenburg (SE)

(73) Assignee: Carmel Pharma AB, Göteborg (SE)

( * ) Notice: Subject to any disclaimer, the term of this patent is extended or adjusted under 35 U.S.C. 154(b) by 103 days.

(21) Appl. No.: 09/682,739

(22) Filed: Oct. 11, 2001

(65) Prior Publication Data

US 2003/0070726 A1 Apr. 17, 2003

(51) Int. Cl.[7] ..... B65B 1/04; B65B 3/04; B67C 3/00

(52) U.S. Cl. ..... 141/329; 141/2; 141/97; 141/319; 141/366; 141/383; 141/384; 604/411

(58) Field of Search ..... 141/2, 4, 5, 9, 141/97, 311 R, 319, 329, 330, 346, 363, 364, 365, 366, 369, 383, 384; 604/411–413, 416

(56) References Cited

U.S. PATENT DOCUMENTS 4,564,054 A 1/1986 Gustavsson
4,576,211 A * 3/1986 Valentini et al. ..... 141/329
6,253,804 B1 * 7/2001 Safabash ..... 141/97

FOREIGN PATENT DOCUMENTS

| | | |
|---|---|---|
| EP | 0255025 A1 | 2/1988 |
| EP | 0259582 A1 | 3/1988 |
| FR | 2780878 A1 | 1/2000 |
| WO | WO 9927886 | 11/1998 |

* cited by examiner

*Primary Examiner*—Timothy L. Maust
(74) *Attorney, Agent, or Firm*—Howrey Simon Arnold & White LLP

(57) ABSTRACT

A fluid transfer assembly comprising a bottle connector and a drug bottle. The bottle has a neck with an opening covered by a closure, while the connector has a hollow needle for penetrating the closure when establishing a fluid transfer line in the fluid transfer assembly. The assembly further comprises a neck element having locking members for irreversible coupling to the neck and to the connector. The neck element and the connector further comprise interacting guiding members for directing the hollow needle to penetrate the closure at a predetermined angle when establishing the fluid transfer line.

67 Claims, 9 Drawing Sheets

METHOD AND ASSEMBLY FOR FLUID TRANSFER

BACKGROUND OF INVENTION

1. Technical Field

The present invention relates to a fluid transfer assembly comprising a bottle connector and a drug bottle, wherein the bottle has a neck with an opening covered by a closure and the connector has a hollow needle for penetrating the closure when establishing a fluid transfer line in the fluid transfer assembly. The invention further relates to a neck element, a bottle connector, and a drug bottle for use in such a fluid transfer assembly, and to a method for fluid transfer using the fluid transfer assembly.

2. Background Information

When preparing drugs, e.g., intended for injection or infusion, demands are made on aseptic conditions. As a rule, special safety boxes or cabinets located in a clean room environment have been utilized in order to achieve such aseptic conditions.

A serious problem in connection with drug preparation and other similar handling is the risk of exposing medical and pharmacological staff to drugs or solvents which might escape into the ambient air. This problem is particularly serious where the preparation of cytotoxins, antiviral drugs, antibiotics and radio-pharmaceuticals are concerned. It has been found that safety boxes according to the present technology often provide insufficient environmental protection. For example, cytotoxins can evaporate at room temperature. Safety boxes and cabinets according to the present technology are provided with filters for filtration of circulating and exhaust air. Conventional, or HEPA filters are able to trap aerosols and particles, but not evaporated substances. Furthermore, aerosols and other particles which are initially trapped in the filters can transform into their gas phase and be released into the ambient air. For these reasons, there is a need for safer systems for handling drugs and other medical substances.

Accordingly, U.S. Pat. No. 4,564,054 to Gustavsson ("the '054 patent") discloses a fluid transfer device for transferring a substance from one vessel to another vessel while avoiding leakage of liquid and gas contaminants. The device comprises a first member designed as a hollow sleeve and having a piercing member, thereby providing a passageway. The piercing member is attached to the first member, which has a first barrier member at one end just opposite the tip of the piercing member. Thereby, the piercing member can be passed and retracted through the first barrier member that seals one end of the first member.

The fluid transfer device of the '054 patent further comprises a second member that is attached to or attachable to one of the vessels or to means arranged to communicate therewith. The second member has a second barrier member and mating connection means arranged on the first and second members for providing a releasable locking of the members with respect to each other. The barrier members are liquid and gas-proof sealing members, which seal tightly after penetration and retraction of the piercing member and prevent leakage of liquid as well as gas contaminants. In the connected position of the first and second members, the barrier members are located in such a way with respect to each other that the piercing member can be passed there through.

According to the '054 patent, the above-mentioned piercing member is a needle arranged for puncturing the first and second barrier members, wherein the end opposite to the one end of the first member has means for sealingly receiving or being permanently attached to an injection syringe or the like for withdrawing and/or adding substance to the vessel attached to the second member. When attached to the first member, the injection syringe or the like communicates with the passageway of the needle, so that in the retracted position the needle is hermetically enclosed in the first member having the injection syringe or the like connected thereto.

In another system for handling drugs and other medical substances, International Patent Application No. PCT/US98/24665 to Fowles et al. ("the '665 application") discloses a connector device for establishing fluid communication between a first container and a second container. The connector device has a first sleeve member with a first and second end. The first sleeve member has a first attaching member at the first end that is adapted to attach to the first container. The connector device further has a second sleeve member with a first and second end. The second sleeve member is combinable with the first sleeve member and movable with respect thereto from an inactivated position to an activated position, wherein the second sleeve member has a second attaching member at the second end adapted to attach the second sleeve member to the second container.

According to the '665 application, the connector device further comprises a first and second piercing member projecting from one of the first and second sleeve members for providing a fluid flow path from the first container to the second container. The connector device further provides a means for independently hermetically sealing the first and second members.

Still, it has been found that the current systems for safer handling of hazardous medical substances often are difficult to connect to drug bottles (or other fluid containers) which are used for the handling. Furthermore, in some of the previously known systems there may be a risk that a drug bottle or other handling container accidentally is detached from the handling system. This is of course not acceptable.

One difficulty when connecting several of the present handling systems to a drug bottle having an opening covered by a membrane or another closure is that a hollow needle or other piercing member of a connector device or the like has to penetrate the membrane substantially perpendicularly and with a linear motion in order to avoid that the membrane is ruptured or that the aperture through the membrane formed by the hollow needle becomes too large and allows hazardous substances to escape into the environment. This linear motion can be difficult to achieve with the present fluid transfer systems, and requires a great amount of care and patience from the user coupling such a connector device to a drug bottle.

SUMMARY OF INVENTION

Accordingly, a first object of the present invention is to provide an improved fluid transfer assembly comprising a bottle connector and a drug bottle, which solves the above-mentioned problems and which in a reliable, consistent way reduces the risk of hazardous leakage to the environment. This first object is achieved by means of a fluid transfer assembly having a bottle connector and a drug bottle. The bottle can have a neck with an opening covered by a closure, and the connector can have a hollow needle for penetrating the closure when establishing a fluid transfer line in the fluid transfer assembly. According to the invention, the assembly further comprises a neck element with locking members for irreversible coupling to the neck and to the connector. The neck element and the connector further have interacting guiding members for directing the hollow needle to penetrate the closure at a predetermined angle when establishing the fluid transfer line.

A second object of the present invention is to provide a neck element for use in the fluid transfer assembly according to the invention. This second object is achieved by a neck element for use in a fluid transfer assembly. The neck element has a bottle connector and a drug bottle. The drug bottle has a neck with an opening covered by a closure, and the connector has a hollow needle for penetrating the closure when establishing a fluid transfer line in the fluid transfer assembly. According to the invention, the neck element has locking members for irreversible coupling to the neck and to the connector. The neck element further has guiding members for participating in directing the hollow needle of the connector to penetrate the closure at a predetermined angle when establishing the fluid transfer line.

A third object of the present invention is to provide a bottle connector for use in the fluid transfer assembly according to the invention. This third object is achieved by means of a bottle connector having a hollow needle for penetrating a closure of a drug bottle when establishing a fluid transfer line in the fluid transfer assembly. According to the invention, the assembly further has a neck element with locking members for irreversible coupling to the neck and to the connector. The bottle connector further has guiding members adapted for interacting with corresponding guiding members of the neck element in order to direct the hollow needle to penetrate the closure at a predetermined angle when establishing the fluid transfer line.

A fourth object of the present invention is to provide a drug bottle for use in the fluid transfer assembly according to the invention. This fourth object is achieved by means of a drug bottle having a neck with an opening covered by a closure. The fluid transfer assembly is of a type further including a bottle connector with a hollow needle for penetrating the closure when establishing a fluid transfer line in the fluid transfer assembly. According to the invention, the drug bottle has a neck element irreversibly coupled to the neck by means of locking members, which also are designed to enable irreversible coupling to the connector. The neck element further has guiding members for participating in directing the hollow needle of the connector so as to penetrate the closure at a predetermined angle when establishing the fluid transfer line.

A fifth object of the present invention is to provide an improved method for fluid transfer using a bottle connector and a drug bottle. This fifth object is achieved by means of a method comprising the steps of providing the bottle having a neck with an opening covered by a closure and the connector having a hollow needle, and penetrating the closure with the hollow needle when establishing a fluid transfer line. According to the invention, the method further comprises the steps of providing a neck element having locking members and guiding members, first irreversibly coupling the neck element to the neck and then to the connector by means of the locking members, and there between directing the hollow needle to penetrate the closure at a predetermined angle with the aid of the guiding members of the neck element when establishing the fluid transfer line.

Further objects of the present invention will become evident from the following description. The features enabling these further objects are found in the pending claims.

BRIEF DESCRIPTION OF DRAWINGS

In the following, the present invention will be described in greater detail with reference to the attached drawings, wherein.

DETAILED DESCRIPTION

Following, a preferred embodiment and a number of alternative embodiments of a fluid transfer assembly according to the present invention will be described in greater detail with reference to the attached FIGS. 1–7C.

Figure 1:
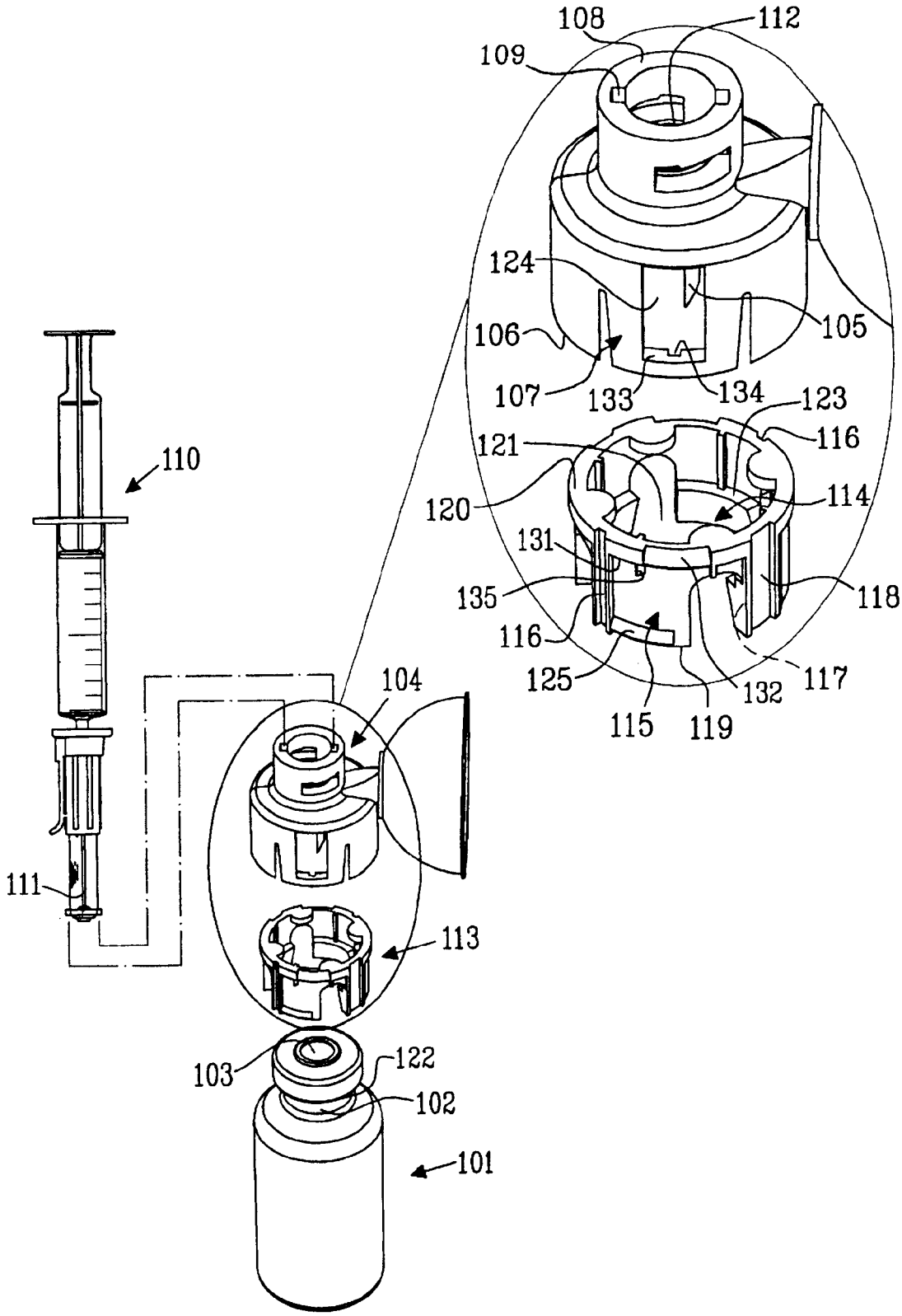
FIG. 1 is a side perspective view of an assembly according to a preferred embodiment of the invention wherein the assembly is shown prior to establishing a fluid transfer line.

Referring to FIG. 1, the fluid transfer assembly according to the invention comprises a bottle connector 104 and a drug bottle 101. As used herein, the expression "drug bottle" refers to any container which is leakage proof and otherwise suitable for the purpose in question. Accordingly, the drug bottle can be a bottle or vial of a conventional type utilized for drugs or medical fluids intended to be administered to a human patient or an animal. Preferably, the drug bottle has only one sealed opening, and is made of a solid, rigid material, such as glass. Furthermore, it is preferred that the drug bottle has no displaceable bottom, flexible walls, or the like, which might increase the risk of hazardous leakage into the environment.

The drug bottle 101 included in the assembly according to the invention has a neck 102 with an opening covered by a closure 103. As used herein, the expression "neck" should be understood as a conventional bottle or vial neck, or as a protruding portion of the fluid container with an edge, shoulder, protrusion or the like, which fulfils the same function. The expression "opening" should be understood as a passageway into the interior of the bottle, whereas the expression "closure" refers to any leakage-proof membrane, film, foil, seal, or the like, made of a material which can be punctured by a hollow needle and which otherwise is suitable for the purpose.

The bottle connector 104 illustrated in FIGS. 1 and 6A–6C has a hollow needle 105 for penetrating the closure 103 when establishing a fluid transfer line L (see, FIG. 5) in the fluid transfer assembly. As used herein, the expression "hollow needle" refers to any suitable piercing device made of, e.g., a metal or polymer, which is provided with an appropriate passageway.

Figure 5:
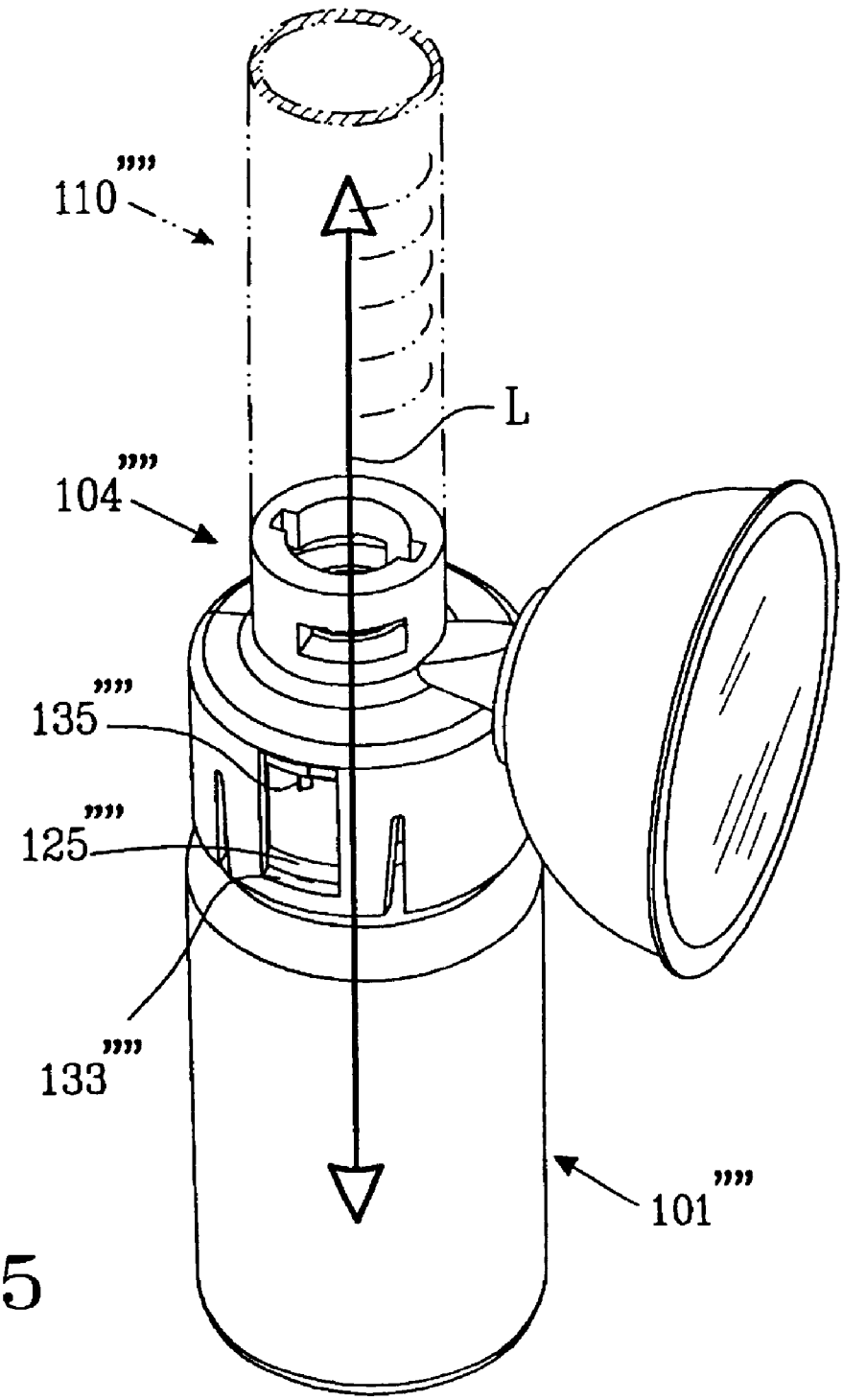
FIG. 5 is a side perspective view of the assembly in FIG. 1 after the completion of the penetration step, wherein a fluid transfer device included in the assembly has been indicated with dash-dotted lines.
Figure 6A:
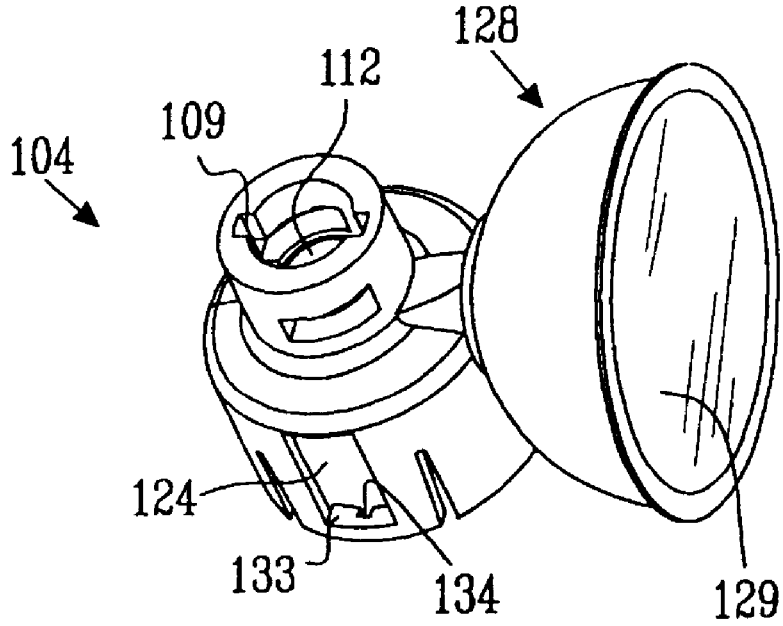
FIG. 6A illustrates a perspective view of a bottle connector according to a preferred embodiment of the invention.
Figure 6B:
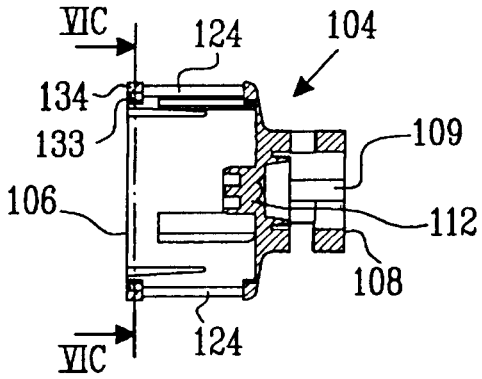
FIG. 6B illustrates a first side cross sectional view of the bottle connector in FIG. 6A.
Figure 6C:
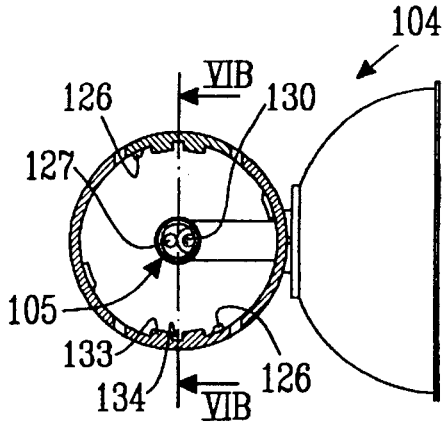
FIG. 6C illustrates a second top cross sectional view of the bottle connector in FIG. 6A.

According to the present invention, the fluid transfer assembly further comprises a neck element 113 as illustrated in FIGS. 1 and 7A–7C. The neck element has locking members 114, 115 for irreversible coupling to the neck 102 of the drug bottle 101 and to the connector 104. FIG. 5 illustrates the assembly in a state when this irreversible coupling has been achieved. As used herein, the expression "irreversible coupling" means that the neck element in normal, intended use cannot be removed from the drug bottle unintentionally, and without the use of excessive force.

According to the invention, the neck element 113 and the bottle connector 104 further have interacting guiding members 116, 126 for directing the hollow needle 105 or other piercing device so as to penetrate the closure 103 at a predetermined angle when establishing the fluid transfer line L. This technical feature ensures that the hollow needle always penetrates the closure in the correct way, thereby reducing the risk of accidental leakage caused by erroneous handling of the fluid transfer system.

In a preferred embodiment of the fluid transfer assembly according to the invention, the bottle connector 104 has a proximate end 106 having first locking members 107 for irreversible coupling to the neck 102, and a distal end 108 with second locking members 109 for coupling to a fluid transfer device 110. The fluid transfer device 110 has a cannula 111, and can be of any type which is previously known per se and commercially available.

In the preferred embodiment, the distal end 108 of the connector 104 exposes a membrane 112 through which the cannula 111 of the fluid transfer device 110, via the hollow needle 105 of the bottle connector 104, can penetrate the closure 103 in order to establish the fluid transfer line L between the bottle 101 and the fluid transfer device 110 after accomplishing the irreversible coupling. Preferably, the neck element 113 has third locking members 114 for irreversibly coupling to the neck 102 prior to establishing the fluid transfer line L. The neck element 113 preferably further comprises fourth locking members 115 for irreversible coupling to the first locking members 107 of the bottle connector.

In the preferred embodiment, the guiding members 116, 126 of the bottle connector 104 and the neck element 113 are designed so as to direct the hollow needle 105 to penetrate the closure 103 of the drug bottle 101 at an angle (relative to a general plane of the closure) which is between about 80° and about 100° when establishing the fluid transfer line L. This technical feature minimizes the size of the opening which is formed in the closure, thereby also minimizing the risk of potentially hazardous leakage to the environment.

Preferably, the neck element 113 is designed for directing the hollow needle 105 to penetrate the closure 103 linearly by means of guided sliding contact between the guiding members 116 of the neck element 113 and the corresponding guiding members 126 of the connector 104.

In one advantageous embodiment, the neck 102 of the bottle 101 exhibits an edge 15 122. In this embodiment, the neck element 113 has an inside 117 and an outside 118 and exhibits a bottle end 119, a connector end 120 and a channel 121 there between. Thereby, the third locking members 114 are provided on the inside 117 at the bottle end 119 of the channel 121 for grasping the edge 122, while the fourth locking members 115 are provided on the outside 118 in a position accessible to the first locking members 107 of the bottle connector 104 when establishing the fluid transfer line L.

The first locking members advantageously comprise a flexible tongue 107.

The second locking members 109 and the membrane 112 advantageously are designed to be included in a double-membrane-bayonet coupling with the fluid transfer device 110. Such double-membrane-bayonet couplings are known per se.

The third locking members advantageously comprise a flexible tongue 114, or a shoulder 123. Particularly advantageously as illustrated in FIG. 1, the third locking members comprise a flexible tongue 114 that has a shoulder 123 for resting on an edge 122 of the neck 102 in order to enable the irreversible coupling between the neck element 113 and the neck 102.

Advantageously, the fourth locking members also has a flexible tongue 115.

Particularly advantageously as illustrated in FIG. 1, the first locking members have a flexible tongue 107 forming an aperture 124, with the fourth locking members having a flexible tongue 115 having a protrusion 125 for entering the aperture 124.

In an alternative embodiment (not shown in the drawings), the fourth locking members have a flexible tongue forming an aperture, with the first locking members having a flexible tongue with a protrusion for entering the aperture.

Accordingly, it is preferred that the first and fourth locking members comprise at least one aperture 124, slit, edge, recess, protrusion 125, shoulder, needle, flexible tongue 107, 115 or spring member enabling the irreversible coupling between the connector 104 and the neck element 113.

In the preferred embodiment of the fluid transfer assembly according to the invention, as illustrated in FIG. 1, the neck element 113 comprises a ring of a flexible polymer material, exhibiting the third locking members 123 on the inside 117 and the fourth locking members 125 on the outside 118 on flexible tongues 114, 115 at the bottle end 119, and further exhibiting axially extending guide grooves 116 along the outside 118 intended to interact with corresponding guide ribs 126 (FIG. 6C) inside the connector 104.

It is preferred that the connector 104 is of a type which has a fluid transfer channel 127 within the hollow needle 105. The connector 104 further preferably has a pressure compensator or compensating means 128 comprising a flexible container 129 and a gas channel 130 within the hollow needle 105 for transporting gas from the bottle 101 to the flexible container 129 or vice versa in order to allow fluid to be transferred via the fluid transfer channel 127. The gas channel 130 preferably includes a filter to prevent liquid passage into the flexible container 129.

In a particularly advantageous embodiment, particularly illustrated in FIGS. 2–5, the connector 104' exhibits geometrical shapes designed to interact with corresponding geometrical shapes of the neck element 113' in a contact step, an activation step, and a penetration step. Thereby, these geometrical shapes enable the connector 104" to couple to the neck element 113" in a detachable way in the contact step, to turn around an axis while contacting the neck element 113" in the activation step, and to be linearly displaced along the axis L, thereby enabling the hollow needle to penetrate the closure of the drug bottle 101" in the penetration step, after which the connector 104" becomes irreversibly coupled to the neck element 113".

Figure 2:
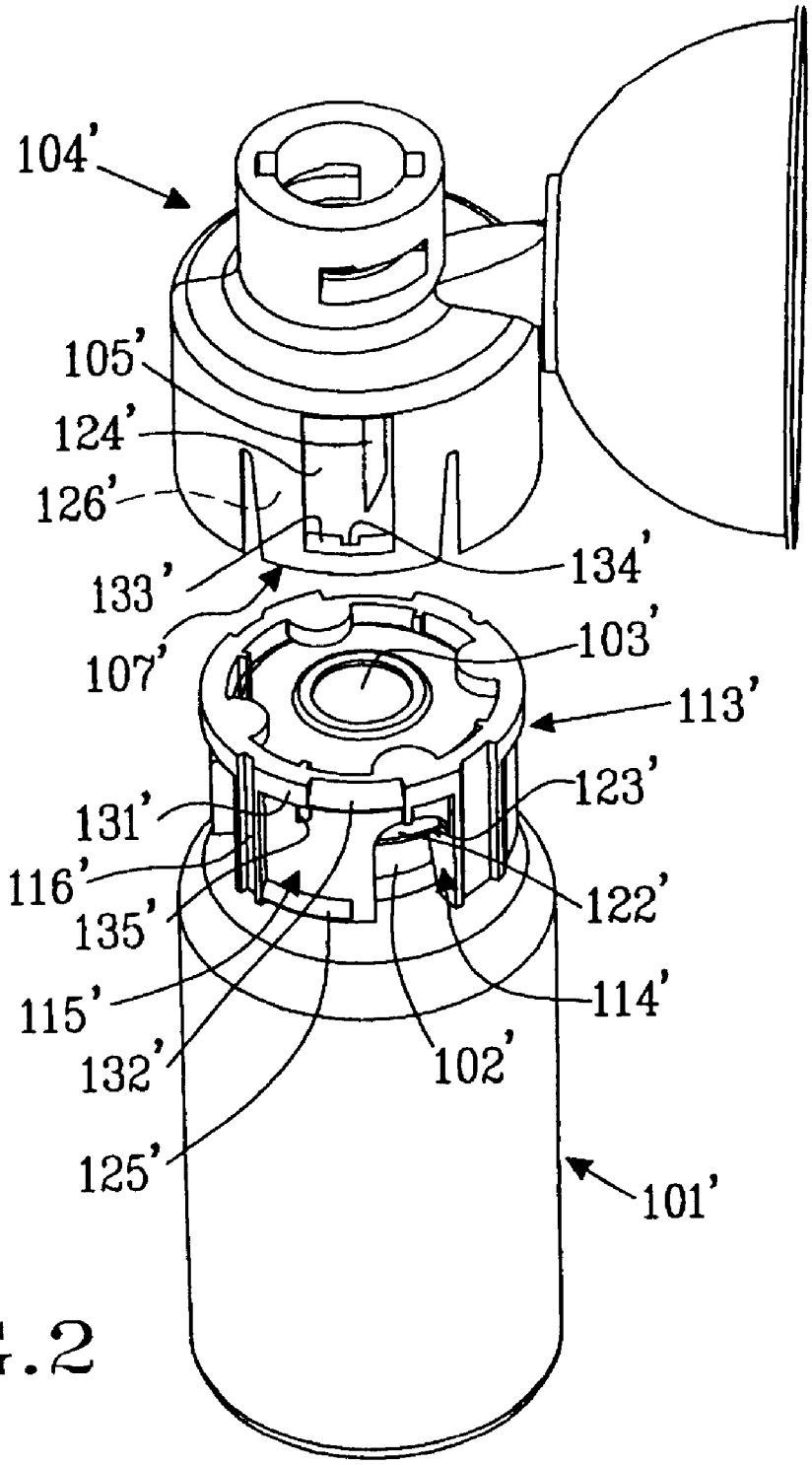
FIG. 2 is a side perspective view of the assembly in FIG. 1 wherein a neck element according to the invention has been irreversibly coupled to a drug bottle.
Figure 3:
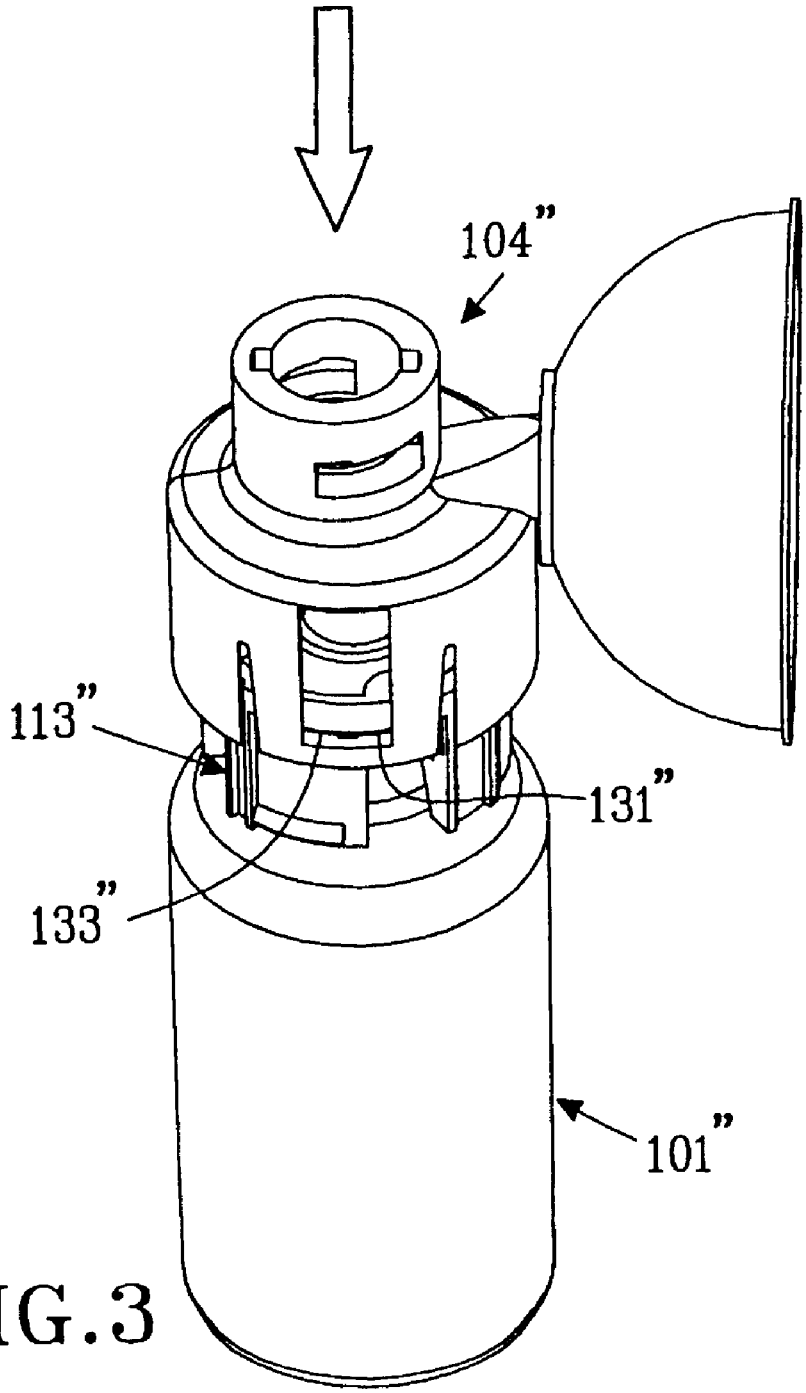
FIG. 3 is a side perspective view of the assembly in FIG. 1 wherein a bottle connector has been brought in contact with the neck element in a contact step.
Figure 4:
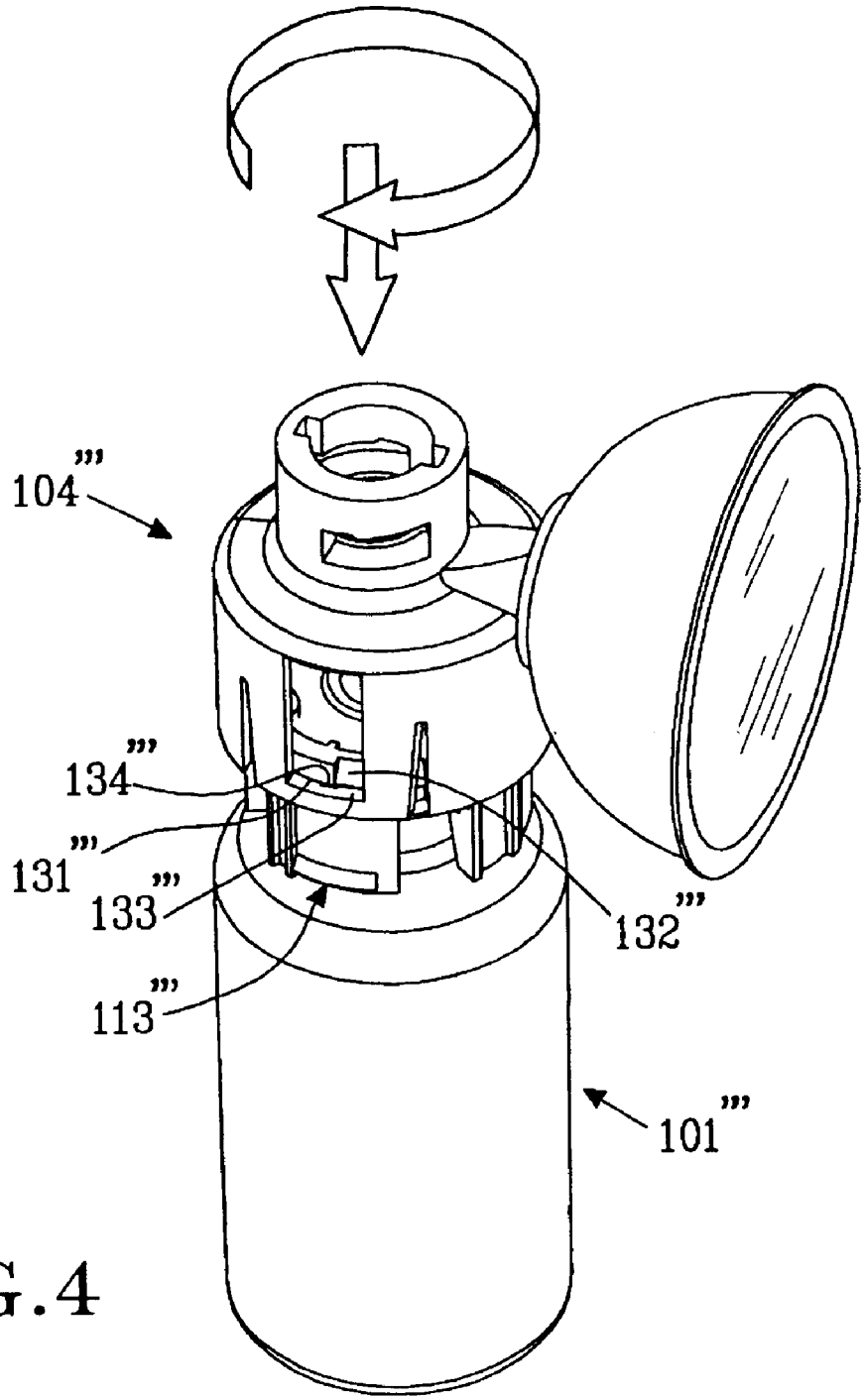
FIG. 4 is a side perspective view of the assembly in FIG. 1 wherein the bottle connector, in an activation step, has been turned around an axis (as illustrated by the arrows) into a position where a penetration step can be started.

In the embodiment shown in FIGS. 1–5, the above-mentioned geometrical shapes of the neck element 113, 113', 113", 113'", 113"" include a first guiding edge 131, 131', 131", 131'", 131"" intended to interact with a second guiding edge 133, 133', 133", 133'", 133"", of the bottle connector 104, 104', 104", 104'" in the above-mentioned contact and activation steps (FIGS. 3–4). Furthermore, the first guiding edge of the neck element exhibits a first recess 132, 132', 132'" intended to allow a guiding member 126 and/or other protruding member of the connector 104 to pass through when initiating the contact step (FIG. 3). The second guiding edge of the bottle connector exhibits a second recess 134, 134', 134'" allowing a protrusion 135', 135" of the neck element to pass through (FIG. 4) when passing from the activation step to the penetration step (FIGS. 4–5).

In an alternative embodiment of the fluid transfer assembly according to the invention, the neck element comprises a ring of a flexible polymer material which is designed to enclose at least a portion of the connector when the irreversible coupling between the neck element and the connector is established. In this alternative embodiment, the locking members and the guiding members of the neck element and the bottle connector have to be modified accordingly. After having read and understood the present description, such a modification can be done by a person skilled in the art.

As has become evident from the foregoing description, the neck element invented by the present inventors is a vital part of the fluid transfer assembly according to the invention.

In the following, a neck element according to the invention will be described in greater detail with particular reference to FIGS. 7A–7C.

The neck element 113 according to the present invention is intended for use in a fluid 115 transfer assembly comprising a bottle connector and a drug bottle, e.g. as shown in FIG. 1. The drug bottle 110 in such an assembly has a neck 102 with an opening covered by a closure 103, while the connector 104 has a hollow needle 105 for penetrating the closure 103 when establishing a fluid transfer line L (FIG. 5) in the fluid transfer assembly, According to the invention, the neck element 113 has locking members 114, 115 for irreversible coupling to the neck 102 and to the connector 104. The neck element 113 further comprises guiding members 116 for participating in directing the hollow needle 105 of the connector 104 to penetrate the closure 103 at a predetermined angle when establishing the fluid transfer line L.

In a preferred embodiment of the neck element 113, the bottle connector 104 included in the assembly exhibits a proximate end 106 having first locking members 107 for the irreversible coupling to the neck 102 and a distal end 108 having second locking members 109 for coupling to a fluid transfer device 110 having a cannula 111. Thereby, the distal end 108 of the bottle connector exposes a membrane 112 through which the cannula 111 via the hollow needle 105 can penetrate the closure 103 in order to establish the fluid transfer line L between the bottle 101 and the fluid transfer device 110 after having accomplished the irreversible coupling.

In the preferred embodiment, the neck element 113 has third locking members 114 for irreversible coupling to the neck 102 before establishing the fluid transfer line L, and further comprises fourth locking members 115 for irreversible coupling to the above-mentioned first locking members 107. Thereby, the guiding members 116 of the neck 10 element 113 are designed for directing the hollow needle 105 to penetrate the closure 103 at an angle which is between 80 and 100° when establishing the fluid transfer line L.

Preferably, the neck element 113 according to the invention is designed for directing 15 the hollow needle 105 to penetrate the closure 103 linearly by means of guided sliding contact between the guiding members 116 and corresponding guiding members 126 (FIG. 6C) of the connector 104 when establishing the fluid transfer line L.

In one advantageous embodiment of the neck element according to the invention, the 20 bottle neck 102 exhibits an edge 122, wherein the neck element 113 has an inside 117 and an outside 118 and exhibits a bottle end 119, a connector end (120) and a channel 121 there between. Thereby, the third locking members 114 are provided on the inside 117 at the bottle end 119 of the channel 121 for grasping the edge 122, and the fourth locking members 115 are provided on the outside 118 in a position accessible to the 25 first locking members 107 of the bottle connector 104 when establishing the fluid transfer line L.

Advantageously, the locking members of the neck element 113 comprise a tongue 114, 115 or a shoulder 123.

Even more advantageously, the locking members of the neck element 113 comprise a flexible tongue 114 which has a shoulder 123 for grasping an edge 122 of the neck 102 for enabling the irreversible coupling between the neck element 113 and the bottle 101. Thereby, the bending stiffness of the flexible tongue is adapted to provide an appropriate locking action.

Advantageously, the locking members of the neck element 113 comprise a tongue 115 having a protrusion 125 for entering an aperture 124 of the connector 104.

Alternatively (not shown in the drawings), the locking members of the neck element comprise a flexible tongue exhibiting an aperture for receiving a protrusion of the connector.

The locking members of the neck element 113 preferably comprise at least one aperture, slit, edge, recess, protrusion 125, shoulder 123, needle, flexible tongue 114, 115 or spring member, enabling the irreversible coupling between the neck element 113 and the connector 104 and between the neck element 113 and the neck 102.

Figure 7A:
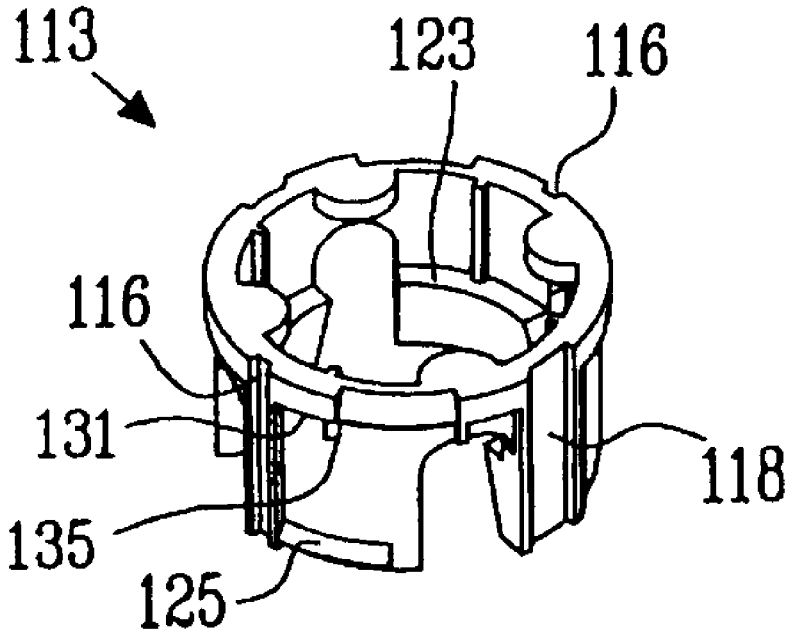
FIG. 7A illustrates a perspective view of a neck element according to a preferred embodiment of the invention.
Figure 7B:
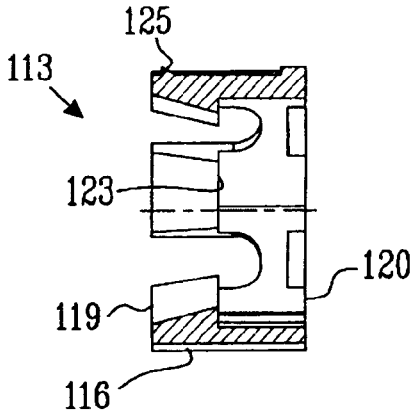
FIG. 7B shows a cross sectional view of the neck element illustrated in FIG. 7A.
Figure 7C:
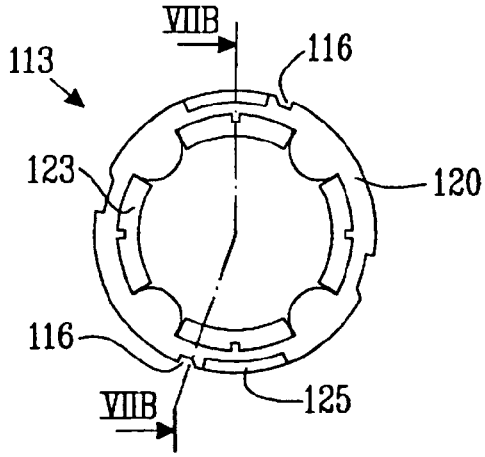
FIG. 7C illustrates a top view of the neck element shown in FIG. 7A.

In the preferred embodiment, particularly illustrated in FIGS. 7A–7C, the neck element 113 comprises a ring of a flexible polymer material, exhibiting locking members 123 on the inside 117 and locking members 125 on the outside 118 on flexible tongues 114, 115 at the bottle end 119. In the preferred embodiment, the neck element further exhibits axially extending guide grooves 116 along the outside 118 intended to interact with corresponding guide ribs 126 (FIG. 6C) inside the connector 104. However, it should be understood that the locking members and the guiding members can be designed in a number of alternative ways as long as appropriate locking members and also guiding members are provided both on the neck element and on the separate bottle connector. Furthermore, the provided locking members should enable both the irreversible coupling between drug bottle and neck element and between neck element and bottle connector, whereas the provided guiding members should enable guiding action required in the penetration step.

The fluid transfer assembly according to the present invention enables a pre-assembly of neck elements and drug bottles, e.g., in a drug production line. Among other things, such a pre-assembly reduces the number of handling steps which medical staff has to perform since the combined drug bottle/neck element substantially is ready for interaction with a separate bottle connector already when delivered to the user.

Accordingly, in a particularly advantageous embodiment, the neck element is irreversibly coupled to the bottle when delivered to a user, wherein the bottle contains a drug, medical fluid, or other medical substance. This embodiment simplifies the use of the fluid transfer assembly, and also makes it possible to utilize neck elements which are even more firmly coupled to the drug bottle than what is possible in embodiments where a user has to apply the neck element himself/herself.

In another advantageous embodiment, the neck element (113') exhibits geometrical shapes designed to interact with corresponding geometrical shapes of the connector 104" in a contact step, an activation step, and a penetration step. Thereby, the geometrical shapes enable the connector 104" to be coupled to the neck element 113" in a detachable way in the contact step, to be turned around an axis while contacting the neck element 113" in the activation step, and to be linearly displaced along the axis L to enable the hollow needle to penetrate the closure of the drug bottle 101" in the penetration step after which the connector 104" becomes irreversibly coupled to the neck element 113".

In an alternative embodiment (not shown in the drawings), the neck element comprises a ring of a flexible polymer material which is designed to enclose at least a portion of the connector when having established the irreversible coupling between the neck element and the connector. In this alternative embodiment having an "inverse" design, the locking members and guiding members have to be modified accordingly.

In the following, a bottle connector for use in the fluid transfer assembly according to the invention will be described in greater detail. The connector 104 is intended for use in an assembly comprising a drug bottle 101 having a neck 102 with an opening covered by a closure 103, wherein the connector 104 has a hollow needle 105 for penetrating the closure 103 when establishing a fluid transfer line L in the fluid transfer assembly.

According to the invention, the assembly further comprises a neck element 113 having locking members 114, 115 for irreversible coupling to the neck 102 and to the connector 104, wherein the bottle connector further comprises guiding members 126 adapted for interacting with corresponding guiding members 116 of the neck element 113 in order to direct the hollow needle 105 to penetrate the closure 103 at a predetermined angle when establishing the fluid transfer line L.

In a preferred embodiment of the bottle connector according to the invention, the connector 104 exhibits a proximate end 106 having first locking members 107 for the irreversible coupling to the neck 102 and a distal end 108 having second locking members 109 for coupling to a fluid transfer device 110 having a cannula 111. Thereby, the distal end 108 exposes a membrane 112 through which the cannula 111 via the hollow needle 105 can penetrate the closure 103 in order to establish the fluid transfer line L between the bottle 101 and the fluid transfer device 110 after having accomplished the irreversible coupling. In the preferred embodiment, the above guiding members 126 of the bottle connector 104 are designed to participate in directing the hollow needle 105 to penetrate the closure 103 at an angle which is between about 80° and about 100° when establishing the fluid transfer line L.

Preferably, the guiding members 126 of the connector 104 are designed for directing the hollow needle 105 to penetrate the closure 103 linearly by means of guided sliding interaction with the corresponding guiding members 116 of the neck element 113.

In the preferred embodiment of the bottle connector according to the invention, the neck element 113 has an inside 117 and an outside 118 and exhibits fourth locking members 115 on the outside 118. Thereby, the above-mentioned first locking members 107 of the bottle connector 104 are adapted to access the fourth locking members 115 when establishing the fluid transfer line L.

The first locking members of the bottle connector advantageously comprise a flexible tongue 107. Particularly advantageously, the first locking members comprise a flexible tongue 107 forming an aperture 124, intended to receive a protrusion 125 on a flexible tongue 110 of the neck element 113. Alternatively (not shown in the drawings), the first locking members comprise a flexible tongue having a protrusion for entering an aperture in a flexible tongue of the neck element.

It is preferred that the first locking members comprise at least one aperture 124, slit, edge, recess, protrusion, shoulder, needle, flexible tongue 107 or spring member adapted for the irreversible coupling to the neck element 113.

The second locking members 109 and the membrane 112 are advantageously designed to include a double-membrane-bayonet coupling with a fluid transfer device 110. Such fluid transfer devices for safe handling of medical substances are commercially available. The double-membrane technique as such is described in greater detail in the above-discussed '054 patent.

In one advantageous embodiment, the bottle connector 104 exhibits internal guide ribs 126 (FIG. 6C) for interacting with corresponding external guide grooves 116 of the neck element 113 in order to direct the hollow needle 105 to penetrate the closure 103 at the predetermined angle (in relation to the plane of the closure) when establishing the fluid transfer line L. However, many alternative designs of the guiding members are conceivable within the scope of the present invention, e.g., embodiments where the guide grooves and guide ribs have reversed positions.

The bottle connector 104 preferably has a fluid transfer channel 127 within the hollow needle 105, and further a pressure compensating means 128 comprising a flexible container 129 and a gas channel 130 within the hollow needle 105 for transporting gas from the bottle 101 to the flexible container 129 or vice versa in order to allow fluid to be transferred via the fluid transfer channel 127, wherein the gas channel 130 includes a filter to prevent liquid passage into said flexible container 129.

In a particularly advantageous embodiment, the connector 104' exhibits geometrical shapes designed to interact with corresponding geometrical shapes of the neck element 113' in a contact step, an activation step, and a penetration step. The geometrical shapes enable the connector 104"" o be coupled to the neck element 113" in a detachable way in the contact step (FIG. 3), to be turned around an axis while contacting the neck element 113" in the activation step (FIG. 4), and to be linearly displaced along the axis L to enable the hollow needle to penetrate the closure of the drug bottle 101" in the penetration step (FIGS. 4–5) after which the connector 104" becomes irreversibly coupled to the neck element 113" FIG. 5).

In an alternative embodiment of the bottle connector according to the invention (not shown in the drawings), the neck element with which the connector is intended to interact comprises a ring of a flexible polymer material, wherein the connector is designed to be at least partially inserted into the ring when having established the irreversible coupling between the connector and the neck element.

In the following, a drug bottle for use in a fluid transfer assembly according to the invention will be described in greater detail with particular reference to FIG. 2. The drug bottle 101' has a neck 102' with an opening covered by a closure 103'. The fluid transfer assembly is of a type further including a bottle connector 104' having a hollow needle 105' for penetrating the closure 103'" when establishing a fluid transfer line L in the fluid transfer assembly.

According to the invention, the drug bottle has a neck element 113' irreversibly coupled to the neck 102' by means of locking members 114' as illustrated by the drug bottle 110' and neck element 113' in FIG. 2. The locking members 115' are also designed to enable irreversible coupling to the connector 104'." Furthermore, according to the invention, the neck element 11'" further comprises guiding members 11'" for participating in directing the hollow needle 10'" of the bottle connector to penetrate the closure 10'" of the drug bottle at a predetermined angle when establishing the fluid transfer line L (FIG. 5).

The above-mentioned guiding members 116'" of the neck element 113'" preferably are designed for directing the hollow needle 10'" to penetrate the closure 10'" at an angle which is between about 80 and about 100° when establishing the fluid transfer line L.

In a particularly advantageous embodiment of the drug bottle according to the 20 invention, the neck element 11" is designed for directing the hollow needle 10" to penetrate the closure 10" linearly by means of guided sliding contact between the guiding members 11" of the neck element 11" and corresponding guiding members 12" of the connector 10" when establishing the fluid transfer line L.

In a preferred embodiment of the drug bottle according to the invention, the neck 10" exhibits an edge 12'. ' Thereby, the neck element 11" has an inside 117 (FIG. 1) and an outside 118 and exhibits a bottle end 119, a connector end 120 and a channel 121 there between. In the preferred embodiment, the locking members 11" are provided on the inside 117 at the bottle end 119 of the channel 121 for grasping the edge 12" and on the outside 118 in a position accessible to interacting locking members 10" on the bottle connector 10" when establishing the fluid transfer line L.

The locking members of the neck element 11" advantageously comprise a flexible 5 tongue 11" 11" or a shoulder 12'. ' Preferably, the locking members of the neck element 11" comprise a flexible tongue 11" which has a shoulder 12" grasping an edge 12" of the neck 10" in order to create the irreversible coupling between the neck element 11" and the bottle 10".'

Furthermore, the locking members of the neck element most advantageously comprise a flexible tongue 11" having a protrusion 12" for entering an aperture 12' the connector 10'.' Alternatively (not illustrated), the locking members of the neck element comprise a flexible tongue exhibiting an aperture for receiving a protrusion of the connector.

The locking members of the neck element 11" preferably comprise at least one aperture, slit, edge, recess, protrusion 12', s5shoulder 12" needle, flexible tongue 1'" "1'" or spring member, which enable(s) the irreversible coupling between the neck element 1"" and the neck 1"" and subsequently between the connector 1"" and the neck element 1'."

In the preferred embodiment of the drug bottle, the neck element 1"" comprises a ring of a flexible polymer material, which exhibits locking members 1"" on the inside 117 and locking members 1"" on the outside 118 on flexible tongues 1"" 1"" at the bottle end 119. Thereby, the neck element further exhibits axially extending guide grooves 1"" along the outside 118 intended to interact with corresponding guide ribs 1"" inside the connector 104.

In a particularly advantageous embodiment, the drug bottle which has the neck element irreversibly coupled thereto contains a drug, medical fluid, or other medical substance when delivered to a user.

In another advantageous embodiment of the drug bottle according to the invention, the neck element 13'" exhibits geometrical shapes designed to interact with corresponding geometrical shapes of the connector 1"" in a contact step, an step, and a penetration step. In this embodiment, the geometrical shapes will enable the connector 14"*t*". o be coupled to the neck element 13"" in a detachable way in the contact step, to be turned around an axis while contacting the neck element 13"*i*" n the activation step. In this embodiment, the geometrical shape of the neck element and the connector will also enable the connector to be linearly displaced along the axis L to enable the hollow needle to penetrate the closure of the drug bottle 11"" in the penetration step after which the connector 14"" becomes irreversibly coupled to the neck element 13.""

In an alternative embodiment of the drug bottle according to the invention (not shown in the drawings), the neck element comprises a ring of a flexible polymer material which is designed to enclose at least a portion of the connector when having established the irreversible coupling between the neck element and the connector.

In the following, a preferred embodiment and a number of alternative embodiments of a method for fluid transfer using a bottle connector and a drug bottle according to the invention will be described in greater detail.

The method comprises to provide the bottle 101 having a neck 102 with an opening covered by a closure 103, and the connector 104 having a hollow needle 105, and to penetrate the closure 103 with the hollow needle 105 when establishing a fluid transfer line.

According to the invention, the method comprises to provide a neck element 113 having locking members 114, 115 and further comprising guiding members 116. The method further comprises to first irreversibly couple the neck element 113 to the neck 102 and then to the connector 104 by means of the locking members 114, 115, and there between to direct the hollow needle 105 to penetrate the closure 103 at a predetermined angle with the aid of the guiding members 116 of the neck element 113 when establishing the fluid transfer line.

In a preferred embodiment of the method according to the invention, the connector 10 104 is provided exhibiting a proximate end 106 having first locking members 107 and a distal end 108 having second locking members 109 and exposing a membrane 112. Furthermore, a fluid transfer device 110 is provided having a cannula 111. The method further comprises to couple the fluid transfer device 110 to the distal end 108 by means of the second locking members 109; and to penetrate the closure 103 with the cannula 111 via the hollow needle 105 in order to establish the fluid transfer line L between the bottle 101 and the fluid transfer device 110. In the preferred embodiment, the method further comprises to direct the hollow needle 105 of the connector 104 to penetrate the closure 103 of the drug bottle 101 at an angle which is between 80 and 100° when establishing the fluid transfer line L (FIG. 5).

The neck element 113 preferably directs the hollow needle 105 to penetrate the closure 103 linearly by means of guided sliding contact between the guiding members 116 and corresponding guiding members 126 of the connector 104.

In one advantageous embodiment of the method according to the invention, a double membrane-bayonet coupling comprising the second locking members 109 and the membrane 112 is created between the distal end 108 and the fluid transfer device 110.

In another embodiment, the bottle 101 is provided with the neck 102 having an edge 122, while the neck element 113 is provided having third locking members comprising a flexible tongue 114 having a shoulder 123, wherein the irreversible coupling between the bottle 101 and the neck element 113 is created by making the shoulder 123 grasp the edge 122.

In a particularly advantageous embodiment of the method, the first 107 locking members are provided comprising a flexible tongue forming an aperture 124, and the neck element 113 is provided having fourth locking members 115 comprising a flexible tongue having a protrusion 125, wherein the irreversible coupling between neck element 113 and the connector 104 is created by making the protrusion 125 enter the aperture 124.

In an alternative embodiment of the method according to the invention (not shown in the drawings), the fourth locking members of the neck element are provided comprising a flexible tongue forming an aperture, and the first locking members of the bottle connector are provided comprising a flexible tongue having a protrusion, wherein the irreversible coupling between the neck element and the connector is created by making the protrusion enter the aperture.

Most advantageously, the irreversible coupling between the neck element 113 and the 20 connector 104 is created by means of at least one aperture 124, slit, edge, recess, protrusion 125, shoulder, needle, flexible tongue 107, 115 or spring member of the first and fourth locking members.

In a particularly preferred embodiment of the method according to the invention, the neck element 122 is provided comprising a ring of a flexible polymer material, which exhibits the third locking members 123 on an inside 117 and the fourth locking members 125 on an outside 118 on flexible tongues 114, 115 at a bottle end 119. In this embodiment, the ring further exhibits axially extending guide grooves 116 along the outside 118, wherein the connector is provided having guide ribs 126 on its inside, and the method further comprises to make the guide grooves 116 interact with the guide ribs 126.

In another advantageous embodiment of the method according to the invention, the connector 104 is provided having a fluid transfer channel 127 within the hollow needle 105, and further having a pressure compensating means 128 comprising a flexible container 129 and a gas channel 130 within the hollow needle 105. In this embodiment, the method further comprises to transport gas from the bottle 101 to the flexible container 129 or vice versa in order to allow fluid to be transferred via the fluid transfer channel 127, wherein the gas channel 130 includes a filter (not shown) preventing liquid passage into the flexible container 129.

As has become evident in the foregoing description, the method according to the invention preferably comprises to provide the drug bottle 101 and the bottle connector 104, and further to provide the neck element (113), to irreversibly couple the neck element 113 to the drug bottle 101, and thereafter to irreversibly couple the bottle connector 104 to the neck element 113, and to couple the bottle connector to a fluid transfer device 110.

In a particularly advantageous embodiment of the method according to the invention, the neck element 1"" exhibits geometrical shapes which interact with corresponding geometrical shapes of the connector 1"" in a contact step, an activation step, and a penetration step. In this embodiment, the contact step comprises to couple the connector 14"*t*" o the neck element 13"" in a detachable way, while the activation step comprises to turn the connector 104" around an axis while contacting the neck element 113". Furthermore, the penetration step comprises to penetrate the closure of the drug bottle 101" by means of the hollow needle, and that the connector 104" is irreversibly coupled to the neck element 113" at the end of the penetration step In an alternative embodiment of the method according to the invention, the neck element is brought to enclose at least a portion of the connector when establishing the irreversible coupling between the neck element and the connector.

In the foregoing description, the present invention has been described in connection with a few specific embodiments and with reference to the attached drawings. However, the present invention is by no means strictly confined to these embodiments or to what is shown in the drawings, but the scope of the invention is defined in the following claims.

Accordingly, for stability reasons, it is preferred that the above-discussed guiding members 116 and 126 are provided in several positions along the circumference or surface of the neck element 116 and the bottle connector 104. However, within the scope of the invention, it is still conceivable with less advantageous embodiments where one single guiding member on either the neck element or the bottle connector is interacting with one or several guiding members of the other interacting component.

An advantage of the fluid transfer assembly according to the present invention is that it enables an individual dosage, and not only a predetermined dosage to be handled or administered to a patient.

Another advantage is that the neck element, which will be in no direct contact with the fluid which is to be handled, can be delivered to the user without having been sterilized.

While there has been disclosed effective and efficient embodiments of the invention using specific terms, it should be well understood that the invention is not limited to such embodiments as there might be changes made in the arrangement, disposition, and form of the parts without departing from the principle of the present invention as comprehended within the scope of the accompanying claims.

What is claimed is:

1. A bottle connector arrangement for use in a fluid transfer assembly that includes a drug bottle having a neck with an opening covered by a closure, the bottle connector comprising:

a hollow needle for penetrating the closure when establishing a fluid transfer line in the fluid transfer assembly, at least one locking member, and a neck element having locking members for irreversible coupling to the neck and a connector, and the bottle connector having guiding members adapted for interacting with corresponding guiding members of the neck element in order to direct the hollow needle to penetrate the closure at a predetermined angle when establishing the fluid transfer line; and wherein at least one connector locking member and a membrane are included in a double-membrane-bayonet coupling with a fluid transfer device.

2. The bottle connector arrangement recited in claim 1, further comprising further comprising:

the connector including a proximate end having first locking members for irreversible coupling to the neck and a distal end having second locking members for coupling to a fluid transfer device, the fluid transfer device further comprising a cannula and being configured so that the distal end exposes a membrane through which the cannula, via the hollow needle, is able to penetrate the closure thereby establishing the fluid transfer line between the bottle and the fluid transfer device after having accomplished the irreversible coupling; and the guiding members of the connector being adapted to participate in directing the hollow needle to penetrate the closure at an angle which is between about 80° and about 100° relative thereto when establishing the fluid transfer line.

3. The bottle connector arrangement recited in claim 1, wherein the connector guiding members are adapted to direct the hollow needle to penetrate the closure linearly by means of guided sliding interaction with corresponding guiding members of the neck element.

4. The bottle connector arrangement recited in claim 1, further comprising:

the neck element has an inside and an outside, and the neck element locking members further include at least one fourth locking member;

the connector further comprises at least one locking member and the at least one fourth locking member is adapted to engage on the outside of the neck element; and at least one connector locking member is adaptable to access the at least one fourth locking member when establishing the fluid transfer line.

5. The bottle connector arrangement recited in claim 1, wherein the connector locking members comprises a flexible tongue.

6. The bottle connector arrangement recited in claim 1, wherein the at least one connector locking member further comprises a flexible tongue for forming an aperture for receiving a protrusion on a flexible tongue of the neck element.

7. The bottle connector arrangement recited in claim 1, wherein the at least one connector locking member further comprises a flexible tongue having a protrusion for entering an aperture in a flexible tongue of the neck element.

8. The bottle connector arrangement recited in claim 1, wherein the at least one connector locking member further comprises at least one aperture, slit, edge, recess, protrusion, shoulder, needle, flexible tongue or spring member adaptable for irreversible coupling to the neck element.

9. The bottle connector arrangement recited in claim 1, wherein the connector further comprises internal guide ribs for interacting with corresponding external guide grooves of the neck element, thereby directing the hollow needle to penetrate the closure at the predetermined angle when establishing the fluid transfer line.

10. The bottle connector arrangement recited in claim 1, further comprising:

a fluid transfer channel within the hollow needle, and a pressure compensator, the pressure compensator comprising a flexible container and a gas channel within the hollow needle for transporting gas from the bottle to the flexible container and vice versa thereby allowing fluid transfer via the fluid transfer channel; and the gas channel comprising a filter for preventing liquid passage into the flexible container.

11. The bottle connector arrangement recited in claim 1, further comprising:

the connector including geometrical shapes and the neck element including corresponding geometrical shapes, the connector geometrical shapes adapted to interact with the neck element corresponding geometrical shapes in a contact step, an activation step, and a penetration step; and the geometrical shapes enabling the connector to be detachably coupled to the neck element in the contact step, to be turned around an axis while contacting the neck element in the activation step, and to be linearly displaced along the axis, thereby enabling the hollow needle to penetrate the closure of the drug bottle in the penetration step after which the connector becomes irreversibly coupled to the neck element.

12. The bottle connector arrangement recited in claim 1, the neck element further comprising a flexible polymer material ring, wherein the connector is adapted to be at least partially inserted into the ring when having established the irreversible coupling between the connector and the neck element.

13. A drug bottle for use in a fluid transfer assembly, the drug bottle having a neck with an opening covered by a closure and a neck element irreversibly coupled to the neck by means of locking members;

the fluid transfer assembly being of a type comprising a bottle connector having a hollow needle for penetrating the closure when establishing a fluid transfer line in the fluid transfer assembly;

the locking members also being able to irreversibly couple to the connector;

wherein the neck element further comprises guiding members for participating in directing the hollow needle of the connector to penetrate the closure at a predetermined angle when establishing the fluid transfer line; and the locking members of the neck element further comprise at least one of a flexible tongue having a protrusion for entering an aperture of the connector and a flexible tongue having an aperture for receiving a protrusion of the connector.

14. The drug bottle recited in claim 13, the guiding members able to direct the hollow needle to penetrate the closure at an angle which is between about 80° and about 100° relative thereto when establishing the fluid transfer line.

15. The drug bottle recited in claim 13, wherein the neck element is able to direct the hollow needle to penetrate the closure linearly by means of guided sliding contact between the guiding members and corresponding guiding members of the connector when establishing the fluid transfer line.

16. The drug bottle recited in claim 13, wherein the neck further comprises an edge, an inside, an outside, and a bottle end, a connector end and a channel therebetween, and wherein the locking members are provided on the inside at the bottle end of the channel for grasping the edge, and on the outside in a position accessible to interacting locking members on the bottle connector when establishing the fluid transfer line.

17. The drug bottle recited in claim 13, wherein the neck element locking members further comprise a flexible tongue.

18. The drug bottle recited in claim 13, wherein the neck element locking members further comprise a shoulder.

19. The drug bottle recited in claim 13, wherein the neck element locking members further comprise a flexible tongue, the tongue comprising a shoulder grasping an edge of the neck, thereby creating the irreversible coupling between the neck element and the bottle.

20. The drug bottle recited in claim 13, wherein the neck element locking members further comprise a flexible tongue, the tongue comprising a protrusion for entering an aperture of the connector.

21. The drug bottle recited in claim 13, wherein the neck element locking members further comprise a flexible tongue, the tongue comprising an aperture for receiving a protrusion of the connector.

22. The drug bottle recited in claim 13, wherein the neck element locking members further comprise at least one aperture, slit, edge, recess, protrusion, shoulder, needle, flexible tongue or spring member, thereby enabling the irreversible coupling between the neck element and the neck, and subsequently between the connector and the neck element.

23. A drug bottle for use in a fluid transfer assembly, the drug bottle having a neck with an opening covered by a closure and a neck element irreversibly coupled to the neck by means of locking members;

the fluid transfer assembly being of a type comprising a bottle connector having a hollow needle for penetrating the closure when establishing a fluid transfer line in the fluid transfer assembly;

the locking members also being able to irreversibly couple to the connector;

wherein the neck element further comprises guiding members for participating in directing the hollow needle of the connector to penetrate the closure at a predetermined angle when establishing the fluid transfer line;

the neck element further comprising a flexible polymer material ring, an inside, an outside, and a bottle end;

wherein at least one of the locking members is engageable on the inside and at least one of the locking members is engageable on the outside on one or more flexible tongues; and wherein the flexible tongues are located at the bottle end and the neck element further comprises axially extending guide grooves along the outside intended to interact with corresponding guide ribs inside the connector.

24. The drug bottle recited in claim 23, wherein the drug bottle comprising the neck element irreversibly coupled thereto further comprises a drug, medical fluid, or other medical substance when delivered to a user.

25. The drug bottle recited in claim 23, further comprising:

the neck element having geometrical shapes and the connector having corresponding geometrical shapes;

the neck element geometrical shapes adapted to interact with the connector geometrical shapes in a contact step, an activation step, and a penetration step, the geometrical shapes enabling the connector to detachably couple to the neck element in the contact step, to turned around an axis while contacting the neck element in the activation step, and to be linearly displaced along the axis thereby enabling the hollow needle to penetrate the closure of the drug bottle in the penetration step after which the connector becomes irreversibly coupled to the neck element.

26. The drug bottle recited in claim 24, the neck element further comprising a flexible polymer material ring for enclosing at least a portion of the connector when having established the irreversible coupling between the neck element and the connector.

27. An arrangement for utilization in a fluid transfer assembly in which a bottle connector, a drug bottle with a neck having an opening covered by a closure, and the connector having a hollow needle for penetrating the closure when establishing a fluid transfer line in the fluid transfer assembly, the arrangement comprising:

a neck element having locking members adapted for irreversible coupling the neck and the connector; and said neck element further comprising guiding members adapted for directing the hollow needle of the connector, in penetration of the closure, at a predetermined angle when establishing the fluid transfer line;

a connector having a proximate end having first locking members for said irreversible coupling to the neck and a distal end having second locking members for coupling to the fluid transfer device; and the fluid transfer device having a cannula, and the distal end exposing a membrane through which the cannula, via the hollow needle, can penetrate the closure to establish the fluid transfer line between the bottle and the fluid transfer device after having accomplished the irreversible coupling;

the neck element further comprising third locking members for irreversible coupling to said neck before establishing said fluid transfer line, and fourth locking members for irreversible coupling to said first locking members; and the guiding members of said neck element being designed to direct the hollow needle to penetrate the closure at an angle between about 80° and about 100° relative thereto when establishing the fluid transfer line.

28. The arrangement for utilization in a fluid transfer assembly recited in claim 27, the neck element being adapted to direct the hollow needle, in penetration of the closure, linearly by means of guided sliding contact between the guiding members and corresponding guiding members of the connector when establishing the fluid transfer line.

29. The arrangement for utilization in a fluid transfer assembly recited in claim 27, further comprising:

said neck having an edge, an inside, an outside, a bottle end, a connector end, and a channel therebetween;

the third locking members being provided on the inside at the bottle end of the channel for grasping the edge; and the fourth locking members being provided on the outside in a position accessible to the first locking members when establishing the fluid transfer line.

30. The arrangement for utilization in a fluid transfer assembly recited in claim 27, wherein the locking members of the neck element further comprises a flexible tongue.

31. The arrangement for utilization in a fluid transfer assembly recited in claim 27, the locking members of the neck element further comprising a flexible tongue having a shoulder for grasping an edge of the neck thereby enabling the irreversible coupling between the neck element and the bottle.

32. The arrangement for utilization in a fluid transfer assembly recited in claim 27, the locking members of the neck element further comprising a flexible tongue having a protrusion for entering an aperture of the connector.

33. The arrangement for utilization in a fluid transfer assembly recited in claim 27, further comprising:

the neck element having a ring of a flexible polymer material, an inside, an outside, and a bottle end; and at least one locking member is engageable on the inside and at least one locking member is engageable on the outside on flexible tongues at the bottle end; and guide grooves axially extend along the outside for interacting with corresponding guide ribs inside the connector.

34. The arrangement for utilization in a fluid transfer assembly recited in claim 27, the neck element being irreversibly coupled to the bottle when delivered to a user, wherein the bottle contains at least one of a drug, a medical fluid, and other medical substance.

35. The arrangement for utilization in a fluid transfer assembly recited in claim 27, further comprising:

the neck element having geometrical shapes and the connector having geometrical shapes, wherein the neck element geometrical shapes interact with the connector geometrical shapes in a contact step, an activation step, and a penetration step; and wherein the geometrical shapes enable the connector to couple with the neck element in a detachable way in the contact step, to turn around an axis while contacting the neck element in the activation step, and to be linearly displaced along the axis thereby enabling the hollow needle to penetrate the closure of the drug bottle in the penetration step, after which the connector becomes irreversibly coupled to the neck element.

36. The arrangement for utilization in a fluid transfer assembly recited in claim 27, wherein the neck element comprises a ring of a flexible polymer material for enclosing at least a portion of the connector when having established the irreversible coupling between the neck element and the connector.

37. A fluid transfer assembly comprising:

a drug bottle having a neck with an opening covered by a closure;

a bottle connector having a hollow needle for penetrating said closure when establishing a fluid transfer line in said fluid transfer assembly;

a neck element having locking members for irreversible coupling to said neck and to said connector;

said neck element and said connector further comprising interacting guiding members for directing said hollow needle to penetrate said closure at a predetermined angle when establishing said fluid transfer line;

first locking members at a proximate end of said connector for said irreversible coupling to said neck, second locking members at a distal end of said connector for coupling to a fluid transfer device, said fluid transfer device having a cannula, and said distal end exposing a membrane through which said cannula, via said hollow needle, can penetrate said closure in order to establish said fluid transfer line between said bottle and said fluid transfer device after having accomplished said irreversible coupling;

said neck element further comprising third locking members for said irreversible coupling to said neck before establishing said fluid transfer line;

fourth locking members for irreversible coupling to said first locking members; and wherein said guiding members are designed for directing said hollow needle to penetrate said closure at an angle between about 80° and about 100° when establishing said fluid transfer line.

38. The fluid transfer assembly as recited in claim 37, further comprising:

said neck having an edge;

said neck element having an inside and an outside, a bottle end, a connector end, and a channel therebetween;

said third locking members being provided on said inside at said bottle end of said channel for grasping said edge; and said fourth locking members being provided on said outside in a position accessible to said first locking members when establishing said fluid transfer line.

39. The fluid transfer assembly as recited in claim 37, wherein said first locking members further comprise a flexible tongue.

40. The fluid transfer assembly recited in claim 37, wherein said second locking members and said membrane are included in a double-membrane-bayonet coupling with said fluid transfer device.

41. The fluid transfer assembly recited in claim 37, wherein said third locking members further comprise a flexible tongue.

42. The fluid transfer assembly recited in claim 37, wherein the third locking members further comprise a shoulder.

43. The fluid transfer assembly recited in claim 37, wherein said third locking members comprise a flexible tongue having a shoulder for resting on an edge of said neck thereby enabling said irreversible coupling between said neck element and said neck.

44. The fluid transfer assembly recited in claim 37, wherein the fourth locking members further comprise a flexible tongue.

45. The fluid transfer assembly recited in claim 37, wherein said first locking members further comprise a flexible tongue forming an aperture and wherein said fourth locking members further comprise a flexible tongue having a protrusion for entering said aperture.

46. The fluid transfer assembly recited in claim 37, wherein said fourth locking members further comprise a flexible tongue forming an aperture and wherein said first locking members further comprise a flexible tongue having a protrusion for entering said aperture.

47. The fluid transfer assembly recited in claim 37, wherein said first and fourth locking members comprise at least aperture, slit, edge, recess, protrusion, shoulder, needle, flexible tongue or spring member for enabling said irreversible coupling between said connector and said neck element.

48. The fluid transfer assembly recited in claim 37, further comprising:

said neck element having a ring of a flexible polymer material, an inside, an outside, and a bottle end; and said third locking members being engageable on said inside and said fourth locking members are engageable on said outside on flexible tongues at said bottle end and further comprising axially extending guide grooves along said outside intended to interact with corresponding guide ribs inside said connector.

49. A fluid transfer assembly comprising:

a drug bottle having a neck with an opening covered by a closure;

a bottle connector having a hollow needle for penetrating said closure when establishing a fluid transfer line in said fluid transfer assembly;

a neck element having locking members for irreversible coupling to said neck and to said connector, said locking members of said neck element further comprising at least one of a flexible tongue having a protrusion for entering an aperture of said connector and a flexible tongue having an aperture for receiving a protrusion of said connector; and said neck element and said connector further comprising interacting guiding members for directing said hollow needle to penetrate said closure at a predetermined angle when establishing said fluid transfer line.

50. The fluid transfer assembly as recited in claim 49, wherein the neck element is designed for directing said hollow needle to penetrate said closure linearly by means of guided sliding contact between said guiding members and corresponding guiding members of said connector.

51. The fluid transfer assembly recited in claim 49, further comprising:

said connector having a fluid transfer channel within said hollow needle;

a pressure compensator having a flexible container and a gas channel within said hollow needle for transporting gas from said bottle to said flexible container and vice versa thereby allowing fluid to be transferred via said fluid transfer channel; and said gas channel having a filter for preventing liquid passage into said flexible container.

52. The fluid transfer assembly recited in claim 49, further comprising:

said connector being geometrical shaped and said neck element further comprising corresponding geometrical shapes;

said geometrical shapes of said connector interact with said neck element geometrical shapes in a contact step, an activation step, and a penetration step;

said geometrical shapes enabling said connector to couple with said neck element in a detachable way in said contact step, to turn around an axis while contacting said neck element in said activation step, and to be linearly displaced along said axis thereby enabling said hollow needle to penetrate said closure of said drug bottle in said penetration step, after which said connector becomes irreversibly coupled to said neck element.

53. The fluid transfer assembly recited in claim 49, further comprising:

said neck element having a ring of flexible polymer material for enclosing at least a portion of said connector when having established said irreversible coupling between said neck element and said connector.

54. An arrangement for utilization in a fluid transfer assembly in which a bottle connector, a drug bottle with a neck having an opening covered by a closure, and the connector having a hollow needle for penetrating the closure when establishing a fluid transfer line in the fluid transfer assembly, the arrangement comprising:

a neck element having locking members adapted for irreversible coupling the neck and the connector, and the neck element further comprising at least one of a flexible tongue having a protrusion for entering an aperture of the connector and a flexible tongue having an aperture for receiving a protrusion of the connector; and said neck element further comprising guiding members adapted for directing the a hollow needle of the connector, in penetration of the closure, at a predetermined angle when establishing the fluid transfer line.

55. The arrangement for utilization in a fluid transfer assembly recited in claim 54, the locking members of the neck element further comprises a shoulder.

56. A method for fluid transfer using a bottle connector and a drug bottle, the method comprising the steps of:

providing the bottle a neck with an opening covered by a closure;

providing the connector with a hollow needle;

penetrating the closure with the hollow needle when establishing a fluid transfer line;

providing a neck element having locking members and guiding members; and first irreversibly coupling the neck element to the neck and then to the connector by means of the locking members, and therebetween directing the hollow needle to penetrate the closure at a predetermined angle with the aid of the guiding members of the neck element when establishing the fluid transfer line;

providing at least one first locking member having a flexible tongue forming an aperture and the neck element providing at least one fourth locking member comprising a flexible tongue having a protrusion; and wherein the irreversible coupling between the neck element and the connector is created by making the protrusion enter the aperture.

57. The method recited in claim 56, further comprising:

providing the connector a proximate end having first locking members and a distal end having second locking members;

exposing a membrane;

providing a fluid transfer device comprising a cannula;

coupling the fluid transfer device to the distal end by means of the second locking members; and penetrating the closure with the cannula via the hollow needle thereby establishing the fluid transfer line between the bottle and the fluid transfer device; and directing the hollow needle to penetrate the closure at an angle which is between about 80° and about 100° relative thereto when establishing the fluid transfer line.

58. The method recited in claim 56, further comprising the step of directing the hollow needle to penetrate the closure linearly by means of guided sliding contact between the neck element guiding members and corresponding guiding members of the connector.

59. The method recited in claim 56, further comprising the step of creating a double-membrane-bayonet coupling comprising one or more second locking members and the membrane between the distal end and the fluid transfer device.

60. The method recited in claim 56, further comprising:

providing the bottle having the neck with an edge; and providing the neck element with one or more third locking members, the third locking members comprising a flexible tongue having a shoulder; and wherein the irreversible coupling between the bottle and the neck element is created by making the shoulder grasp the edge.

61. The method recited in claim 56, further comprising the step of creating the irreversible coupling between the neck element and the connector by means of at least one aperture, slit, edge, recess, protrusion, shoulder, needle, flexible tongue or spring member of one or more first locking members of the connector and one or more fourth locking members of the neck element.

62. The method recited in claim 56, further comprising:

providing the drug bottle and the bottle connector;

providing the neck element; and irreversibly coupling the neck element to the drug bottle and thereafter irreversibly coupling the bottle connector to the neck element, and coupling the bottle connector to a fluid transfer device.

63. The method recited in claim 56, further comprising:

providing the neck element with geometrical shapes and the connector with corresponding geometrical shapes;

interacting the geometrical shapes of the neck element with the corresponding geometrical shapes of the connector in a contact step, an activation step, and a penetration step, and wherein the contact step further comprises the step of coupling the connector to the neck element in a detachable way, wherein the activation step further comprises the step of turning the connector around an axis in while contacting the neck element, wherein the penetration step further comprises penetrating the closure of the drug bottle by means of the hollow needle; and irreversibly coupling the connector to the neck element at the end of the penetration step.

64. The method recited in claim 56, further comprising the step of enclosing at least a portion of the connector with the neck element when establishing the irreversible coupling between the neck element and the connector.

65. A method for fluid transfer using a bottle connector and a drug bottle, the method comprising the steps of:

providing the bottle a neck with an opening covered by a closure;

providing the connector with a hollow needle;

penetrating the closure with the hollow needle when establishing a fluid transfer line;

providing a neck element having locking members and guiding members;

first irreversibly coupling the neck element to the neck and then to the connector by means of the locking members, and therebetween directing the hollow needle to penetrate the closure at a predetermined angle with the aid of the guiding members of the neck element when establishing the fluid transfer line; and providing the neck elements with one or more fourth locking members comprising a flexible tongue forming an aperture and providing the connector with one or more first locking members comprising a flexible tongue having a protrusion, wherein the irreversible coupling between the neck element and the connector is created by making the protrusion enter the aperture.

66. A method for fluid transfer using a bottle connector and a drug bottle, the method comprising the steps of:

providing the bottle a neck with an opening covered by a closure;

providing the connector with a hollow needle;

penetrating the closure with the hollow needle when establishing a fluid transfer line;

providing a neck element having locking members and guiding members;

first irreversibly coupling the neck element to the neck and then to the connector by means of the locking members, and therebetween directing the hollow needle to penetrate the closure at a predetermined angle with the aid of the guiding members of the neck element when establishing the fluid transfer line;

wherein the neck element further comprises a flexible polymer material ring, an inside and outside, one or more third locking members on the inside and at least one fourth locking member on the outside on flexible tongues at a bottle end, and the ring further comprising axially extending guide grooves along the outside and the connector further comprising guide ribs on its inside; and making the guide grooves interact with the guide ribs.

67. A method for fluid transfer using a bottle connector and a drug bottle, the method comprising the steps of:

providing the bottle a neck with an opening covered by a closure;

providing the connector with a hollow needle;

penetrating the closure with the hollow needle when establishing a fluid transfer line;

providing a neck element having locking members and guiding members;

first irreversibly coupling the neck element to the neck and then to the connector by means of the locking members, and therebetween directing the hollow needle to penetrate the closure at a predetermined angle with the aid of the guiding members of the neck element when establishing the fluid transfer line;

providing a fluid transfer channel within the hollow needle of the connector;

providing a pressure compensator comprising a flexible container and a gas channel within the hollow needle; and transporting gas from the bottle to the flexible container or vice versa in order to allow fluid to be transferred via the fluid transfer channel, wherein the gas channel includes a filter preventing liquid passage into the flexible container.

* * * * *